US007436109B2

(12) United States Patent
Lee et al.

(10) Patent No.: US 7,436,109 B2
(45) Date of Patent: Oct. 14, 2008

(54) FLAT PANEL LIGHT SOURCE LUMINANCE ENHANCING METHOD FOR FIELD EMISSION DISPLAY BY PLACING GLASS FRIT ON TOP SURFACE OF REFLECTIVE FILM COATED ON MULTIPLE PATTERNED SLOTS TO FORM FLAT SURFACE WITH THICKNESS EQUAL TO SLOT DEPTH

(75) Inventors: Cheng-Chung Lee, Tai-Tung (TW); Ming-Chun Hsiao, Hsinchu (TW); Biing-Nan Lin, Tai-Chung (TW); Wei-Yi Lin, Yun-Lin Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 287 days.

(21) Appl. No.: 11/281,869

(22) Filed: Nov. 17, 2005

(65) Prior Publication Data

US 2007/0069616 A1 Mar. 29, 2007

(30) Foreign Application Priority Data

Sep. 27, 2005 (TW) ..... 94133561 A

(51) Int. Cl.
*H01J 1/62* (2006.01)
*H01J 63/04* (2006.01)

(52) U.S. Cl. ..... 313/495; 313/238; 313/582; 445/24

(58) Field of Classification Search ..... None
See application file for complete search history.

(56) References Cited

U.S. PATENT DOCUMENTS

| | | | | |
|---|---|---|---|---|
| 5,760,858 | A | 6/1998 | Hodson et al. | 349/61 |
| 6,426,590 | B1 | 7/2002 | Chung et al. | 313/496 |
| 6,639,632 | B2 | 10/2003 | Cheng et al. | 349/12 |
| 2006/0232207 | A1 * | 10/2006 | Sugimoto et al. | 313/582 |
| 2007/0052359 | A1 * | 3/2007 | Yim et al. | 313/582 |

* cited by examiner

*Primary Examiner*—Toan Ton
*Assistant Examiner*—Britt Hanley

(57) ABSTRACT

A method for enhancing the luminance and uniformity of a flat panel light source provides a patterned reflective structure to reflect or deflect the light back onto the display area of a field emission display panel and lighten the area which used to be blocked by spacers. The patterned reflective structure may be designed in several places, such as between an end surface of a spacer and the inner surface of an anode substrate, or on the inner surface of the edges of the side-frame between the anode plate and the cathode plate by further coating a reflective material, or on the side-frames surrounding the panel by further coating a reflective material, etc. With such a patterned reflective structure, the luminance and uniformity of a flat panel light source are enhanced.

7 Claims, 10 Drawing Sheets

FLAT PANEL LIGHT SOURCE LUMINANCE ENHANCING METHOD FOR FIELD EMISSION DISPLAY BY PLACING GLASS FRIT ON TOP SURFACE OF REFLECTIVE FILM COATED ON MULTIPLE PATTERNED SLOTS TO FORM FLAT SURFACE WITH THICKNESS EQUAL TO SLOT DEPTH

FIELD OF THE INVENTION

The present invention generally relates to a flat panel light source and, more specifically, to a method for enhancing the luminance and uniformity of a flat panel light source and the light source thereof. The invention can be applied to a flat panel light source for field emission displays (FEDs).

BACKGROUND OF THE INVENTION

A conventional field emission display mainly comprises a cathode plate module and an anode plate module. As shown in FIG. 1, the front light FED mainly comprises a cathode plate and an anode plate. The cathode plate comprises a first substrate 101, plural cathode lines 103, plural gate lines 105, a plurality of emitters 107, and a dielectric layer 109. All of the cathode lines 103, the gate lines 105, the emitters 107 and the dielectric layer 109 are formed on the surface of the first substrate 101. The anode plate comprises a second substrate 111, an Indium Tin Oxide (ITO) layer 113 formed on the inner surface of the second substrate 111, and a phosphor layer 115 formed on the top of the ITO layer 113. Electrons emitted from emitters 107 hit the phosphor layer 115 and trigger the phosphor layer 107. The light source triggered by the phosphor layer 107 passes through the anode plate, and is released from the outer surface of the anode plate.

Researches on enhancing the luminance and uniformity of the flat panel light sources for FEDs are still on the way of evolving. One of the researches is for an FED backlight source. The FED backlight source is featured with an extra reflection structure on the anode plate. The added reflection structure reflects the light source triggered by the phosphor onto the cathode plate, and the light source is released from the outer surface of the cathode plate.

Spacers have been used to provide the supporting between the cathode plate and the anode plate in the packaging process for an FED light source. The technology of using spacers has long been criticized for the need for a high width-to-height ratio to minimize the display area blocked by the spacers. By a low drive voltage of electrons, the light source triggered by the phosphor layer may not have satisfactory luminance. To enhance the luminance with the conventional high drive voltage phosphor layer, the voltage between anode electrodes and cathode electrodes has to be increased to grant electrons enough energy on the phosphor layer. The increased voltage disadvantages itself with the current leakage problem. To prevent current leakage, the anode-cathode gap has to be increased. As a result of the increased anode-cathode gap, there is a need for an even higher width-to-height ratio for spacers in order not to affect the quality of the display area. This thus makes the spacer manufacturing even harder.

SUMMARY OF THE INVENTION

The present invention provides a method for enhancing the luminance and uniformity of a flat panel light source and the light source thereof. The present invention thus overcomes the drawback of the affected quality of the display area due to the use of spacers in the packaging process for a conventional FED light source.

The method used in the present invention is a design with a patterned reflective structure. With the reflective structure, the light source triggered by the phosphor can always be reflected or deflected onto the display area which used to be blocked by spacers.

In a first embodiment of the present invention, the reflective structure is designed on the surface of one end of each spacer and on the inner surface of the substrate for the anode plate. The light used to be trapped in the spacer can thus be reflected or deflected onto the other end of the spacer and lighten the surface of the display end.

In a second embodiment of the present invention, the surrounding of each spacer is also coated with a reflective layer. The light used to be inclined into each spacer can thus be fully transmitted to the display area. This thus enhances the display luminance and uniformity for the light source.

In a third embodiment of the present invention, the reflective coating is formed on the inner surface of the edges of the side-frame between the anode plate and the cathode plate. The light from the side-frame of the display panel can be reflected back onto the interior space of the panel and thus enhances the display luminance and uniformity for the light source.

In a fourth embodiment of the present invention, the reflective coating is formed on the side-frames surrounding the substrates for the anode plate and the cathode plate. The light surrounding the substrates of the display panel can be reflected back onto the interior area of the panel and thus enhances the display luminance and uniformity for the light source.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

As described in the previous section, the anode plate for a backlight FED includes a patterned reflective structure that reflects or deflects the light source triggered by the phosphor back onto the cathode plate. Without losing generality, the following uses an FED backlight source as an example to illustrate the detail of how the method of the present invention enhances the luminance and uniformity for a flat panel light source.

The method used in the present invention is a design with a patterned reflective structure. With the reflective structure, the light source triggered by the phosphor can always be reflected or deflected onto the display area which used to be blocked by spacers.

FIG. 2A-FIG. 2D show the cross-sectional views illustrating the manufacturing steps of a first embodiment of the present invention. Wherein a backlight FED is taken as an example. In the first embodiment, the reflective structure is designed on the surface of one end of each spacer and on the inner surface of the substrate for the anode plate. For simplicity, FIG. 2A to FIG. 2D use only one spacer for illustration.

Figure 1:
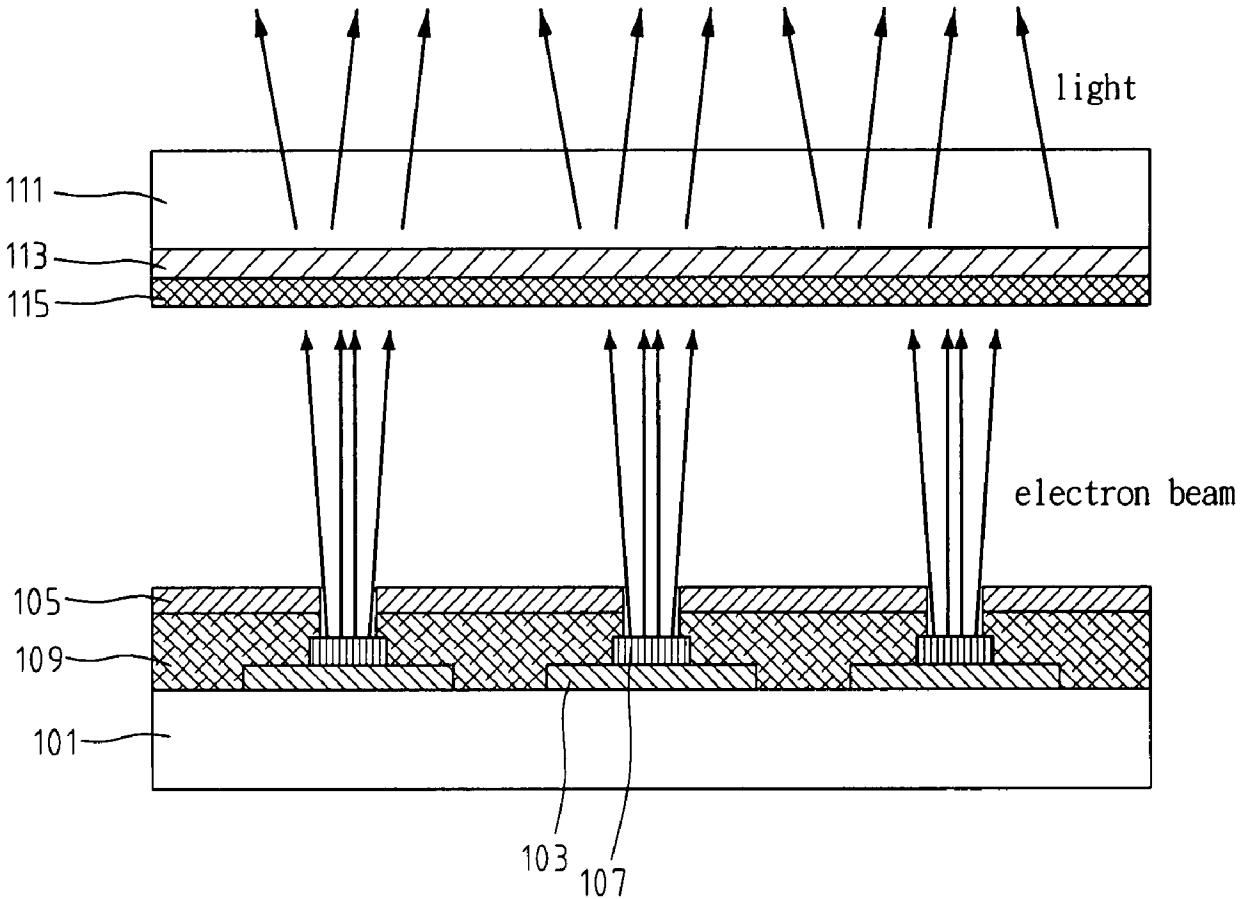
FIG. 1 (Prior Art)
FIG. 1 shows a cross-sectional view of a conventional field emission display.
Figure 2A:
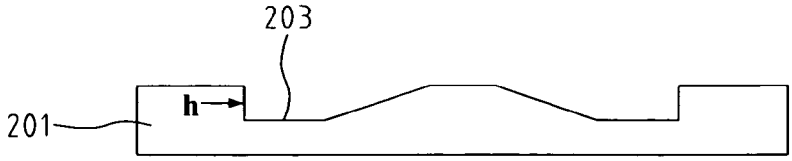
FIG. 2A-FIG. 2D show the cross-sectional views illustrating the manufacturing steps of a first embodiment of the present invention. Wherein a backlight FED is taken as an example.
Figure 2B:
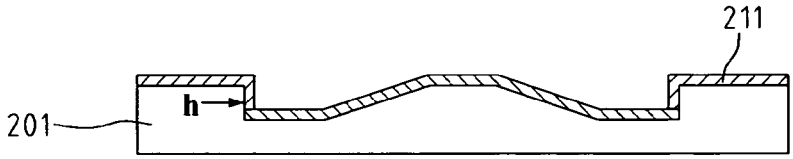
Figure 2C:
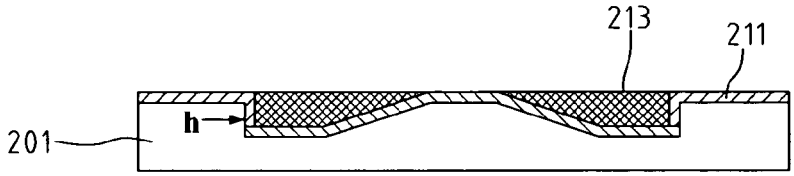
Figure 2D:
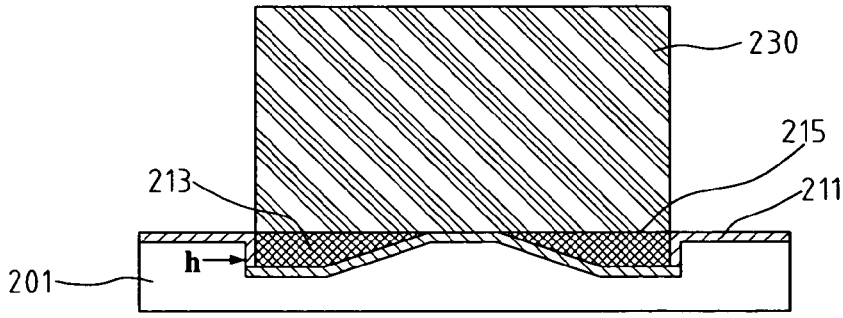

First, the inner surface of the anode substrate 201 is patterned and formed with a plurality of patterned slots 203. In FIG. 2A, only one patterned slot 203 is illustrated for simplicity, wherein, the depth of each patterned slot is h. A reflective film 211 is then coated on the top of the patterned slot 203, as shown in FIG. 2B. On the top of the reflective film 211, the coated patterned slot is filled with the glass frit 213 to form a flat surface 215 for the glass frit 213. The thickness of the glass frit is at least the depth h of the slot. This is illustrated as FIG. 2C. The spacer 230 is further added on the top of the flat surface 215 of the glass frit 213, as shown in FIG. 2D.

According to the present invention, the order for the depth h of the slot is μm. The reflectivity of the glass frit 213 is the same as that of the anode substrate 201 and the spacer 230. If the anode substrate 201 is made of a nontransparent material, then the reflectivity of the glass frit 213 is chosen to be compatible to that of the spacer 230. Patterning on the inner surface of the anode substrate 201 can be accomplished by the processes, such as sand-blasting, etching or laser heating, etc.

Figure 3:
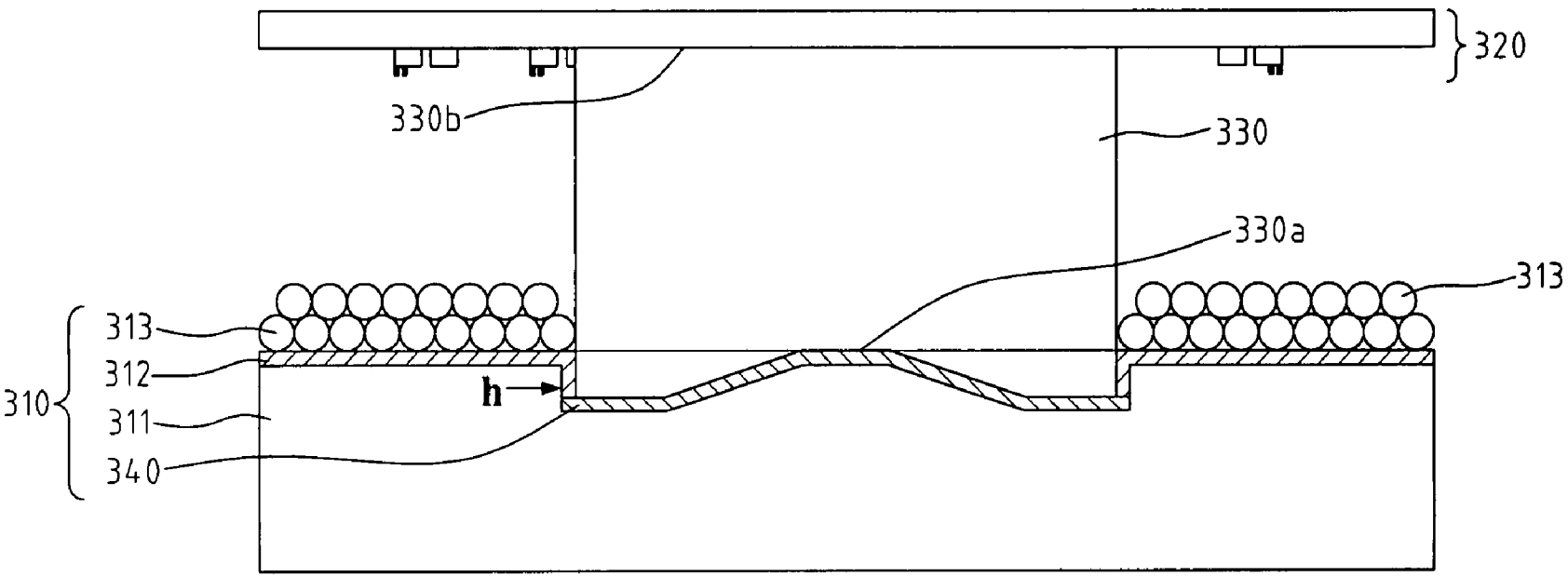
FIG. 3 shows a cross-sectional view of a second embodiment of the present invention.

After every spacer is fabricated, then the gaps among spacers are finished with phosphors. Finally, the anode plate and the cathode plate are assembled to form a complete FED backlight panel. FIG. 3 shows a cross-sectional view of the packaged FED backlight panel.

Referring to FIG. 3, the anode plate 310 of the FED backlight includes a reflective layer 312 formed between the phosphor layer 313 and the anode substrate 311. The patterned reflective film 340 is formed on one side 330*a* of the glass-stob spacer 330, and the inner surface 311 of the anode substrate 310. With the reflective film 340, the light triggered by the phosphor layer 313 and trapped into the spacer 330 can then be reflected or deflected onto the other end 330*b* of the spacer 330 on the cathode plate 320, and lighten the side 330*b* on the cathode plate 320.

Figure 4:
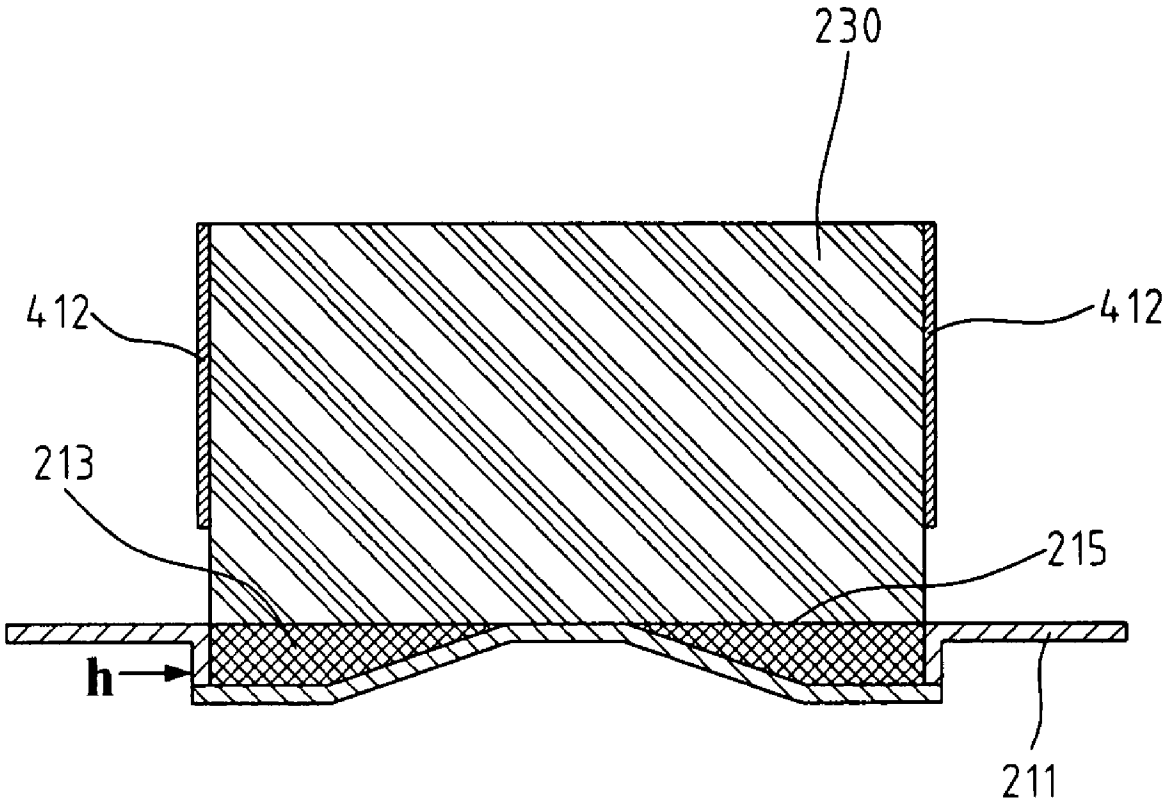
FIG. 4 shows a cross-sectional view for an FED backlight source before assembling the anode and cathode substrates according to the present invention.

According to the present invention, after each spacer is fabricated, and before assembling with the cathode plate, a reflective film 412 can be further coated on the surrounding surface of each spacer, as shown in FIG. 4. This reflective film 412 can make the light more complete transmission into the spacer, thereby enhancing the luminance and uniformity of the flat panel light source. The spacer shown in FIG. 4 is a glass-stob spacer.

Figure 5A:
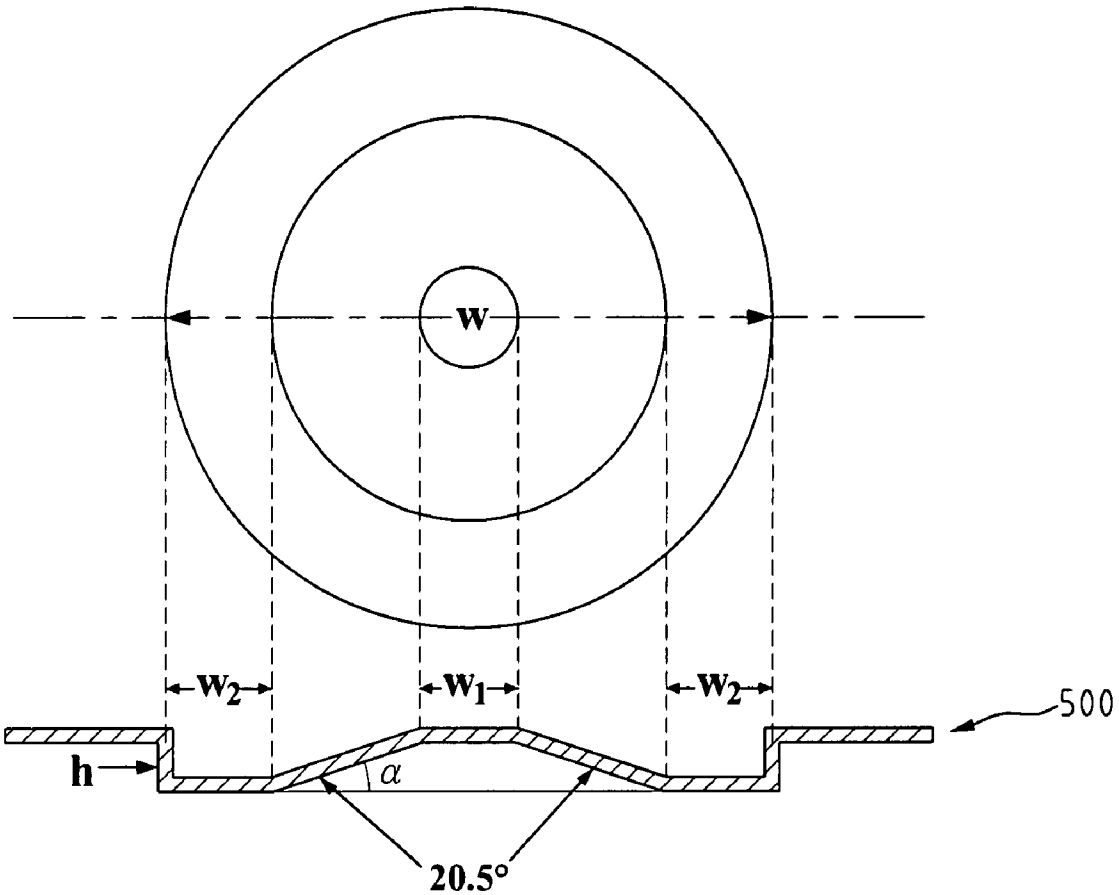
FIG. 5A further illustrates the patterned reflective structure according to the present invention.

FIG. 5A further illustrates the patterned reflective structure according to the present invention. Referring to FIG. 5A, the reflective structure 500 is a left-right symmetric structure, wherein w is the diameter of a cylindrical spacer. With a compatible reflectivity of the materials for the spacer and the glass frit, of value around 1.5, the inclined angle α of the left-right symmetric is about 20.5°. The depth h of the slot 203 depends on individual design. $w_1$ is the contact width for the reflective film 211 and one spacer's end surface. Within the slot 203, $w_2$ is the width for both the left and the right sides of the slot, and h is the depth of the slot.

Figure 5B:
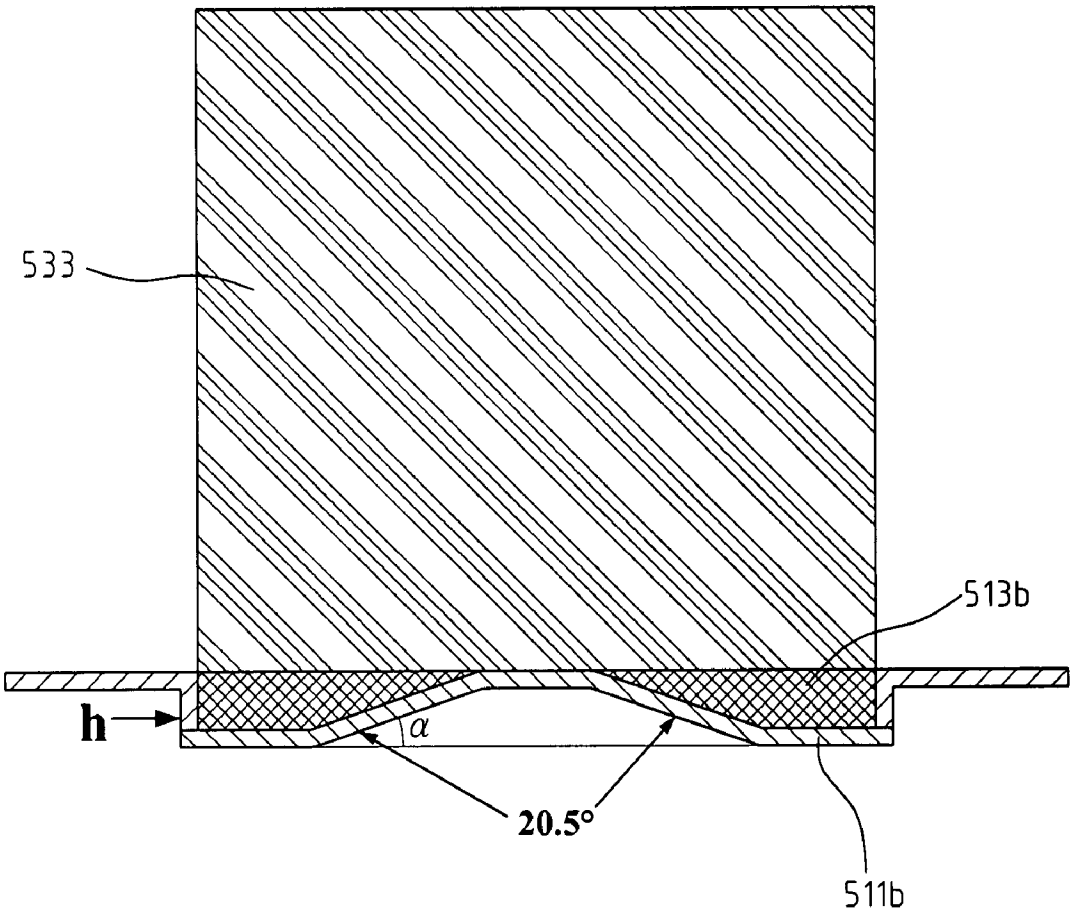
FIG. 5B and FIG. 5C are two examples for the reflective pattern structure.
Figure 5C:
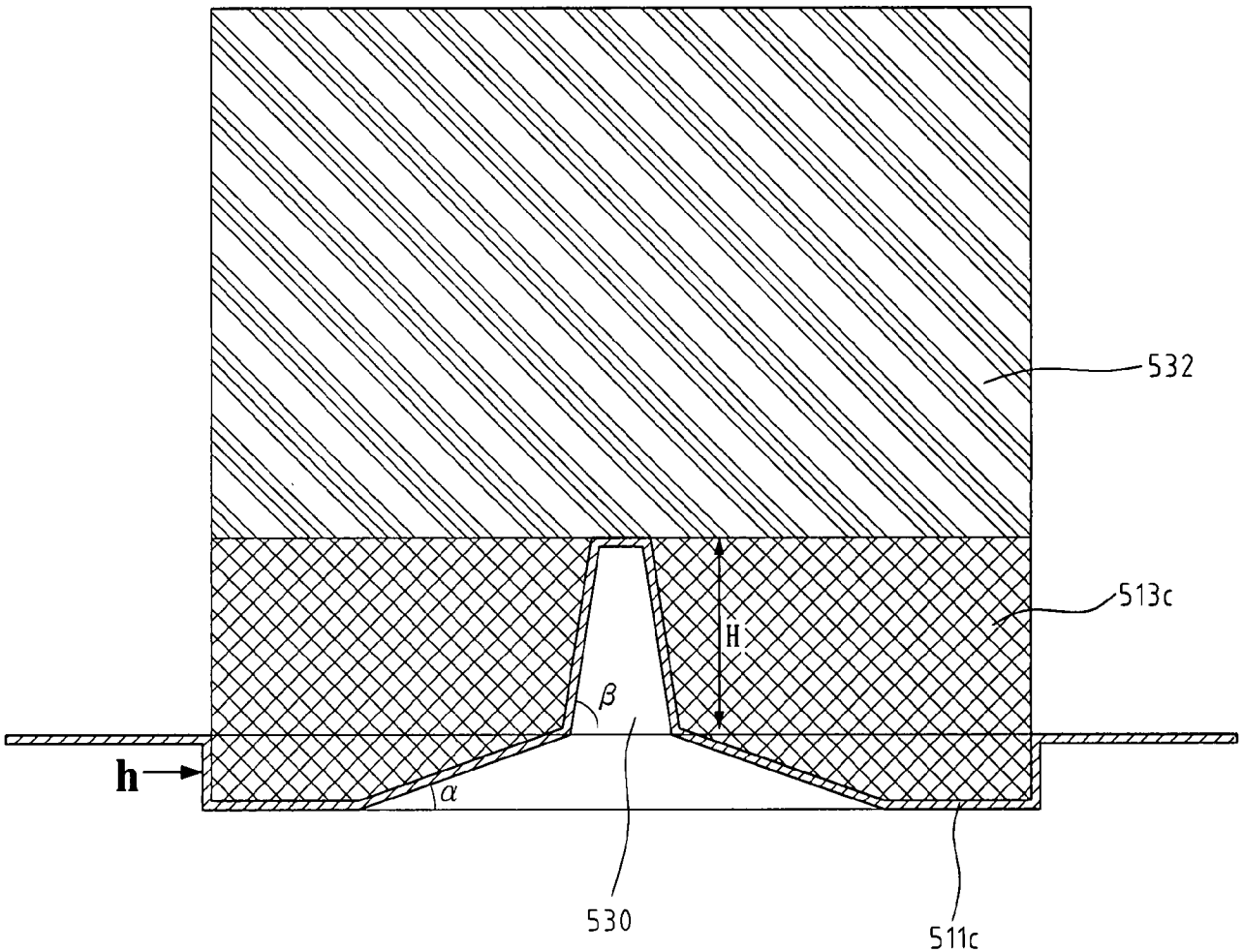

FIG. 5B and FIG. 5C illustrate two variations of the patterned reflective structure, respectively. Wherein, the material 513*c* used for the glass frit in FIG. 5C, has an extra height of H than the material 513*b* used for the glass frit in FIG. 5B. Accordingly, the contact surface of the spacer 532 and the reflective film 511*c* shown in FIG. 5C is higher than, by an extra height of H, that of the spacer 533 and the reflective film 511*b* shown in FIG. 5B. As shown in FIG. 5C, with the addition of a trapezoid 530 with the height of H, the width of the contact surface between the spacer and reflective film of the structure shown in FIG. 5C is narrower than that of the structure shown in FIG. 5B. In other words, the reflective structure shown in FIG. 5C has an extra convex shape with the height of H than the corresponding structure shown in FIG. 5B. The material for the added trapezoid in FIG. 5C is the same for the anode substrate. When the reflectivity of the material used for the spacer and the reflectivity of the glass frit are compatible with a value around 1.5, the inclined angle of the trapezoid β is about 69.5°. The higher the H is the better effect of luminance and uniformity of the light source results. The height H cannot exceed the height of the anode-cathode gap.

Figure 6A:
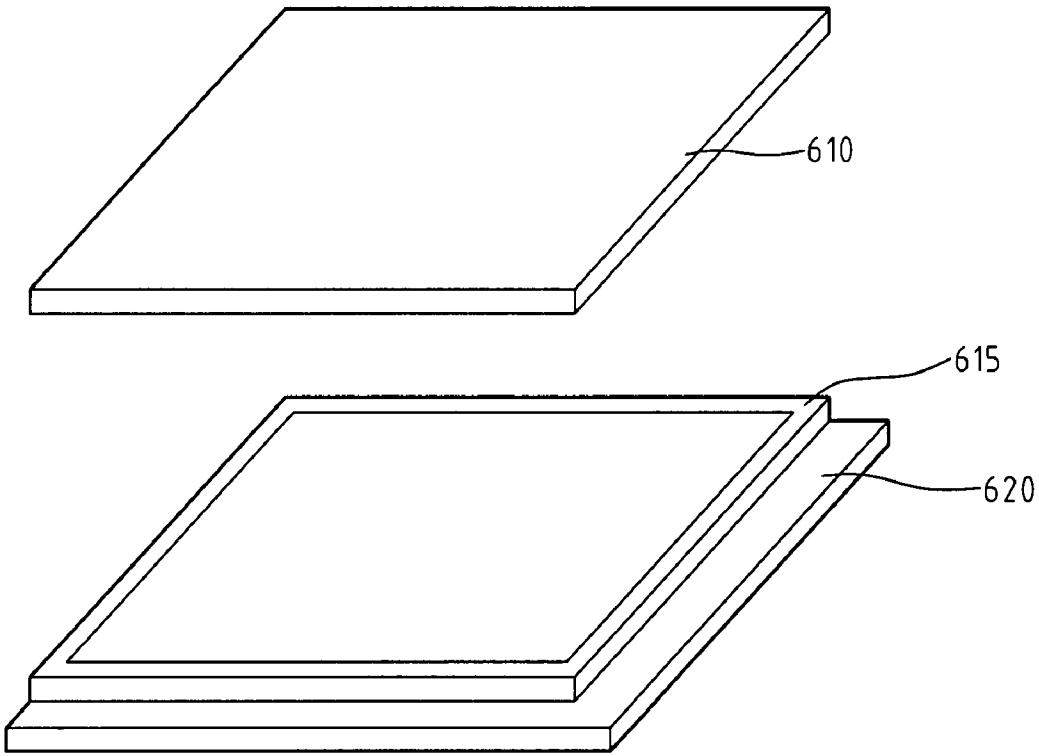
FIG. 6A shows the side-frames between the anode plate and the cathode plate.
Figure 6B:
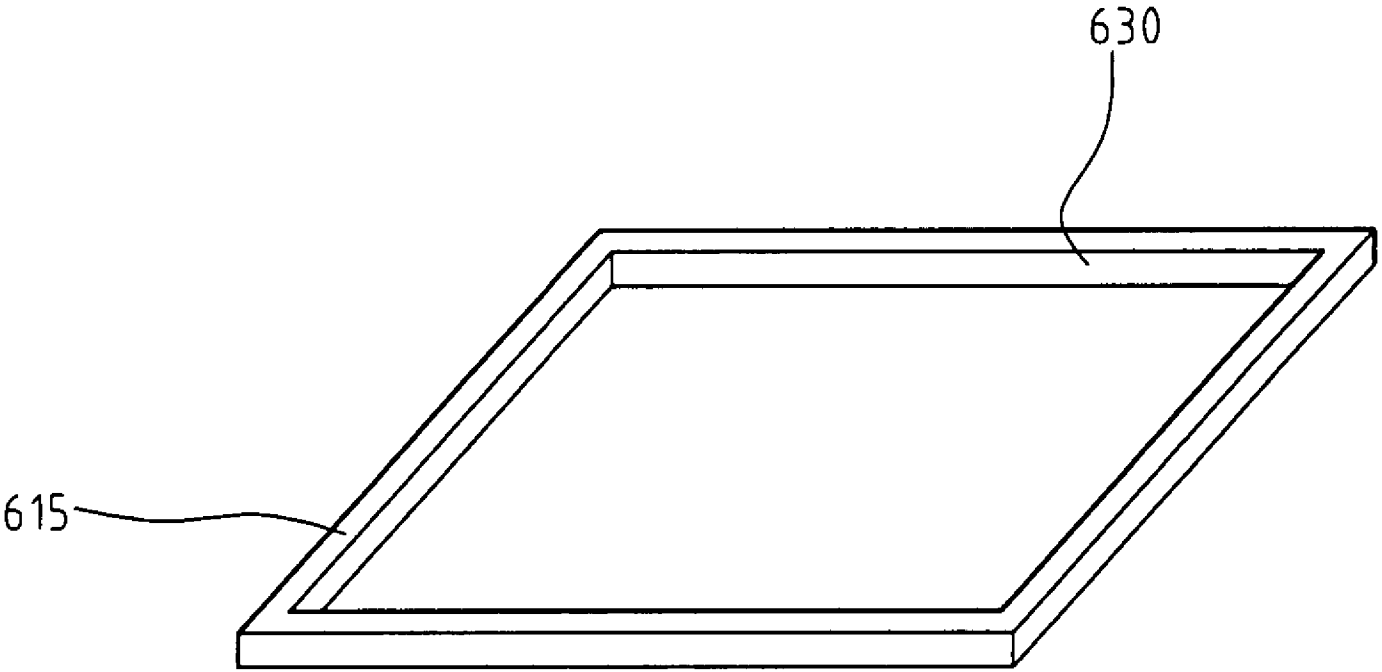
FIG. 6B shows a cross-sectional view of a third embodiment of the present invention t.

According to the present invention, another variation for enhancing the luminance and uniformity of FED light source is to coat a reflective film on the inner surface of the side-frames between the anode plate and the cathode plate. Referring to FIG. 6A, reference 615 points to the side-frame between the anode plate 610 and the cathode plate 620. FIG. 6B shows the reflective film 630 coated on the inner surface of the side-frame 615. With this aid of the reflective film 630, the light from the side-frame of the display panel can be reflected back onto the interior space of the panel and thus enhance both the luminance and uniformity of the light source panel.

Figure 7:
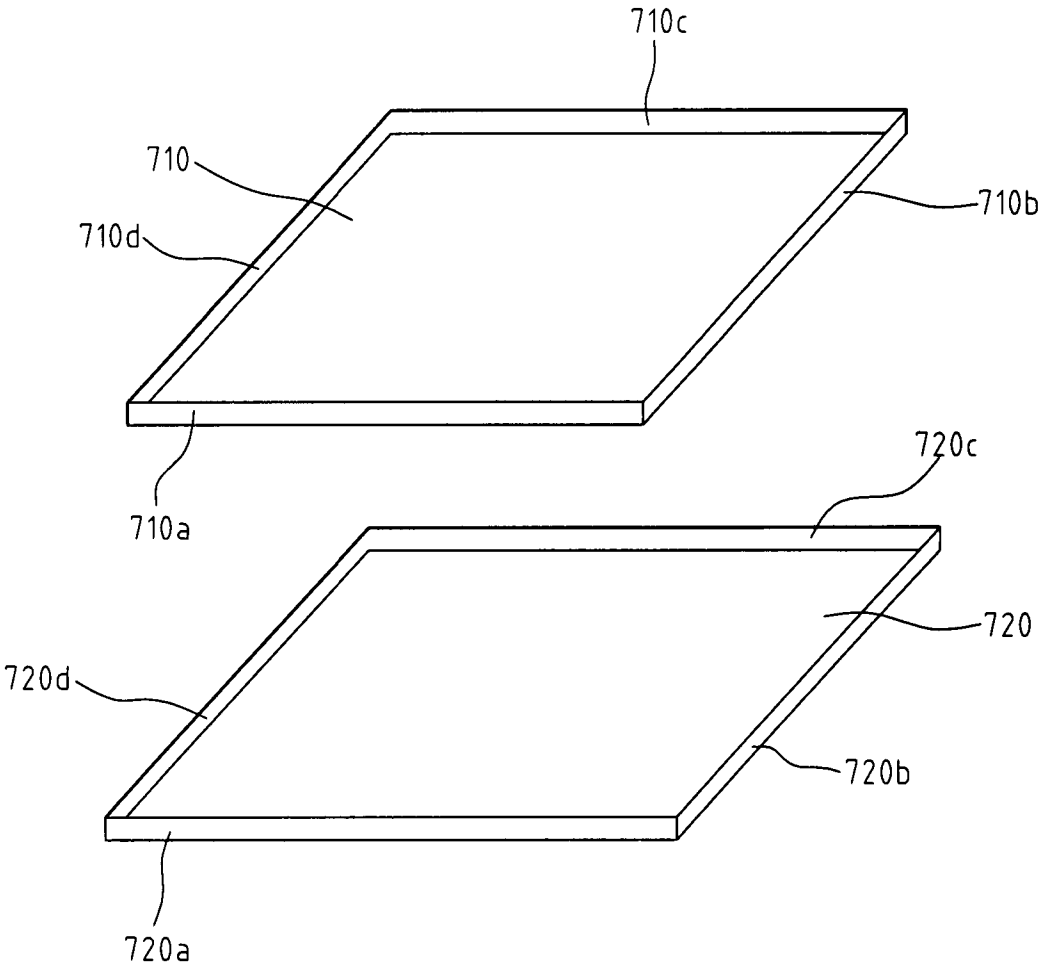
FIG. 7 shows a cross-sectional view of a fourth embodiment of the present invention.

Similarly, another variation for enhancing the luminance and uniformity of an FED light source is to coat a reflective film on the side-frame surrounding the anode plate or/and the cathode plate. Referring to FIG. 7, references 710 and 720 illustrate the side-frames surrounding the anode plate and the cathode plate, respectively. References 710*a*-710*d* and 720*a*-720*d* represent the four surrounding edges of the side-frames for the anode plate and the cathode plate, respectively. They are all coated with reflective films, respectively. With this aid of the reflective films, the light from the side-frame of either the anode or the cathode panel can be reflected back onto the interior space of the display panel and thus achieve the effect of enhanced luminance and uniformity of the flat panel light source.

In summary, the present invention provides a patterned reflective structure to reflect or deflect the triggered light which used to be trapped into the spacers back onto the display area and lightens the display area which used to be affected by the spacers. This thus achieves the effect of enhanced luminance and uniformity of the light source. The patterned reflective structure may be designed in several ways and places. Examples are coating the reflecting film on one end surface of a spacer and the inner surface of an anode substrate, or on the inner surface of the edges of the side-frame between the anode plate and the cathode plate, or on the side-frames surrounding the anode plate and/or the cathode plate. With such a patterned reflective structure, this invention enhances the luminance and uniformity of a flat panel light source.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for enhancing the luminance and uniformity of a flat panel light source, said flat panel light source being composed of a cathode plate, an anode plate and a plurality of spacers, said anode plate comprising at least a substrate, said method comprising the steps of:

patterning an inner surface of said substrate, and said inner surface being formed with a plurality of patterned slots with a depth;

coating a reflective film on the top of said surface of each said patterned slot; and on the top of said reflective film, the coated patterned slot being filled with glass frit to form a flat surface for said glass frit, and the thickness of said glass frit being at least the depth of said slots less the thickness of said reflective film; and adding said plurality of spacers on the top of said flat surface of said glass frit.

2. The method as claimed in claim 1, wherein the order of said depth of said slots is μm.

3. The method as claimed in claim 1, wherein a reflective layer is further coated surrounding each said spacer, after said flat surface for said glass frit is formed.

4. The method as claimed in claim 1, wherein a reflective film is further coated on an inner surface of edges of a side-frame between the anode plate and the cathode plate, after said flat surface for said glass frit is formed.

5. The method as claimed in claim 1, wherein a reflective film is further coated on side-frames surrounding at least a substrate for said flat panel light source, after said flat surface for said glass frit is formed.

6. The method as claimed in claim 5, wherein said substrate for said flat panel light source is the substrate of the anode plate.

7. The method as claimed in claim 5, wherein said substrate for said flat panel light source is the substrate of the cathode plate.

* * * * *